US006619182B2

(12) United States Patent
Attee

(10) Patent No.: US 6,619,182 B2
(45) Date of Patent: Sep. 16, 2003

(54) FLOW CONTROL DEVICE

(75) Inventor: Keith S. Attee, Charlevoix, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 66 days.

(21) Appl. No.: 09/842,570

(22) Filed: Apr. 25, 2001

(65) Prior Publication Data

US 2002/0157527 A1 Oct. 31, 2002

(51) Int. Cl.[7] ..... F15B 11/042; F15B 11/044
(52) U.S. Cl. ..... 91/443; 137/513.7; 137/601.2
(58) Field of Search ..... 91/394, 398, 443; 137/513.7, 601.18, 601.2

(56) References Cited

U.S. PATENT DOCUMENTS

| | | | | |
|---|---|---|---|---|
| 823,480 A | | 6/1906 | McLeod | |
| 2,283,124 A | | 5/1942 | Peterson et al. | 121/38 |
| 2,632,476 A | | 3/1953 | Miller | 138/45 |
| 2,838,072 A | | 6/1958 | Stumm, Jr. | 138/26 |
| 3,013,835 A | | 12/1961 | Blatt | 294/88 |
| 3,267,815 A | | 8/1966 | Ortman et al. | 91/26 |
| 3,303,746 A | * | 2/1967 | Schmoeger | 137/601.18 |
| 3,388,634 A | | 6/1968 | Madland | 91/26 |
| 3,409,050 A | | 11/1968 | Weese | 138/45 |
| 3,470,915 A | | 10/1969 | Bitzer et al. | 138/43 |
| 3,805,672 A | | 4/1974 | Pekrul | 91/396 |
| 3,945,676 A | | 3/1976 | Asamoto | 294/88 |
| 4,700,611 A | | 10/1987 | Kaneko | 91/405 |
| 4,742,849 A | * | 5/1988 | Prudhomme et al. | 91/443 |
| 5,193,433 A | | 3/1993 | Reimer | 92/85 B |
| 6,279,451 B1 | * | 8/2001 | Hirano et al. | 91/443 |

FOREIGN PATENT DOCUMENTS

| | | |
|---|---|---|
| CA | 714881 | 8/1965 |
| GB | 432146 | 7/1935 |
| JP | 55123002 | 9/1980 |
| JP | 57129910 | 8/1982 |

* cited by examiner

*Primary Examiner*—F. Daniel Lopez
(74) *Attorney, Agent, or Firm*—Van Dyke, Gardner, Linn & Burkhart, LLP

(57) ABSTRACT

A flow control apparatus for a fluid cylinder for a workpiece holder includes a flow restricting member and a flexible sealing member. The flow restricting member defines a first passageway and a sealing surface. The flexible sealing member is positioned around the sealing surface. A second passageway is defined between the sealing member and a sealing surface of the flow restricting member when the sealing member is pushed away from the sealing surface in response to fluid flow in a first direction. When fluid flow is applied in the opposite direction, the sealing member moves to engage the sealing surface to substantially limit or preclude fluid flow between the sealing member and the sealing surface in the second direction. The fluid flow in the second direction is thus restricted to flow through the first passageway, thereby slowing or controlling the flow in the second direction.

28 Claims, 4 Drawing Sheets

FLOW CONTROL DEVICE

FIELD OF THE INVENTION

The present invention relates generally to a flow control device for a fluid cylinder and, more particularly, to a flow control device for a fluid cylinder for a work piece holder or gripper assembly.

BACKGROUND OF THE INVENTION

It is known to implement a pneumatic cylinder with a workpiece holder or gripper or the like, such that extension and retraction of a piston rod of the cylinder causes opening and closing of the workpiece holder or gripper assembly. Typically, the air cylinder has no cushioning affect in either direction, which may result in excessive wear and even premature failure of the cylinder or workpiece holder. In order to reduce the shock of the rapid movement of the cylinder in either direction, cushioning devices, such as elastic cushions or the like, have been proposed. However, such cushioning devices may not achieve desired operational results and may require changes within an existing cylinder to facilitate installation of the cushioning device. Additionally, the elastic cushioning devices do not assist in control of the extension and retraction of the piston rod, such that the speed of the opening or retracting stroke is the same in both directions.

SUMMARY OF THE INVENTION

The present invention is intended to provide a fluid flow control device or apparatus for controlling and restricting fluid flow to and from a fluid cylinder in order to control the fluid flow in either direction and to further control the rate of extension or retraction of the piston within the cylinder. The flow control device allows greater flow of fluid in one direction, such as in a direction to extend the piston from the cylinder, while restricting fluid flow in the other direction, in order to reduce the retraction speed of the cylinder and cushion the movement of the piston within the cylinder. The flow control device is mountable to a backing plate of the pneumatic cylinder and is integral within the backing plate to substantially obviate the need for modification of the cylinder and its internal components.

According to a first aspect of the present invention, a flow control apparatus is adaptable to be implemented at a fluid cylinder having a backing plate and being extendable and retractable in response to fluid flow through the backing plate. The flow control apparatus includes a flow restricting member adapted for positioning at the backing plate and a flexible sealing member. The flow restricting member includes a first passageway and a continuous sealing surface. The flexible sealing member is positioned around the sealing surface and adapted for sealing engagement with the backing plate. The flexible sealing member is movable to engage and disengage the sealing surface and disengages the sealing surface to at least occasionally define a second passageway through the flow control apparatus. The sealing member is movable to disengage the sealing surface in response to fluid flow in a first direction such that fluid flows through the second passageway in the first direction. The sealing member is movable to engage the sealing surface in response to fluid flow in a second direction to limit fluid flow between the sealing member and the sealing surface in the second direction. Fluid flows in the second direction through the first passageway. The first direction is generally opposite to the second direction and the flow control apparatus restricts fluid flow in the second direction to control operation of the pneumatic cylinder.

Preferably, the flow restricting member and the sealing member are positionable within a recess in the backing plate. Preferably, the pneumatic cylinder is applicable to a workpiece holder, such that fluid flow in the first direction causes extension of a piston within the cylinder to close the workpiece holder, while fluid flow in the second direction causes retraction of the piston to open the workpiece holder.

In one form, the flow restricting member includes a base portion and a generally cylindrical portion extending therefrom and defining the sealing surface. The base portion defines a third passageway extending at least partially thereacross, wherein the third passageway provides fluid flow to the first and second passageways. The sealing member is secured within a recess in the backing plate and retains the flow restricting member between an inner end wall of the recess and the sealing member. Preferably, the sealing member includes a generally rigid body portion adapted to engage the side wall of the recess and a flexible sealing portion extending from the body portion and being adapted to engage the sealing surface of the flow restricting member in response to fluid flow in the second direction. Preferably, the base portion is seated against the end wall of the recess and includes a chamfered perimeter edge to allow fluid flow around the base portion between at least one end of the third passageway and a supply or exhaust port in the recess of the backing plate.

According to another aspect of the present invention, a pneumatic cylinder for extending and retracting a piston in response to fluid flow is adaptable for connection to a workpiece holder. The pneumatic cylinder comprises a cylinder housing for housing the piston, a backing plate at one end of the housing, and a flow control apparatus. The piston is extendable and retractable along and within the housing in response to fluid flow. The backing plate has at least one port for fluid flow therethrough and a recess having an inner end wall portion interconnected with the port and a side wall portion extending from the end wall portion toward the cylinder housing. The flow control apparatus is positionable within the recess and includes a flow restricting member and a flexible sealing member. The flow restricting member is positionable at the inner end wall portion of the recess and defines a first passageway and a generally uninterrupted, continuous sealing surface. The flexible sealing member includes a body portion and the sealing portion. The body portion is engaged with the side wall of the recess and the sealing portion is positioned around the sealing surface of the flow restricting member for sealing engagement with the sealing surface. The sealing portion is movable from the sealing surface to at least occasionally define a second passageway therebetween. The sealing member is movable to disengage from the sealing surface of the flow restricting member in response to fluid flow in the first direction such that fluid flows through the first and second passageways in the first direction. The sealing member is movable to engage the sealing surface in response to fluid flow in the second direction to limit fluid flow through the second passageway in the second direction, while allowing fluid flow through the first passageway. The flow control apparatus thereby restricts fluid flow in the second direction to control operation of the pneumatic cylinder.

Therefore, the present invention provides a flow control apparatus for a cylinder. The flow restricting member and the sealing member are cooperatively operable to allow fluid flow in a first direction from the port in the backing plate through both the first and second passageways. The flow restricting member and the sealing member are further cooperatively operable to allow fluid flow in the second direction through the first passageway to the port, while substantially precluding flow through the second passageway. The flow control apparatus thus provides for controlled movement of the piston within the cylinder via fluid flow in the second direction.

These and other objects, advantages, purposes and features of this invention will become apparent upon review of the following specification in conjunction with the drawings.

DESCRIPTION OF THE PREFERRED EMBODIMENTS

Figure 1:
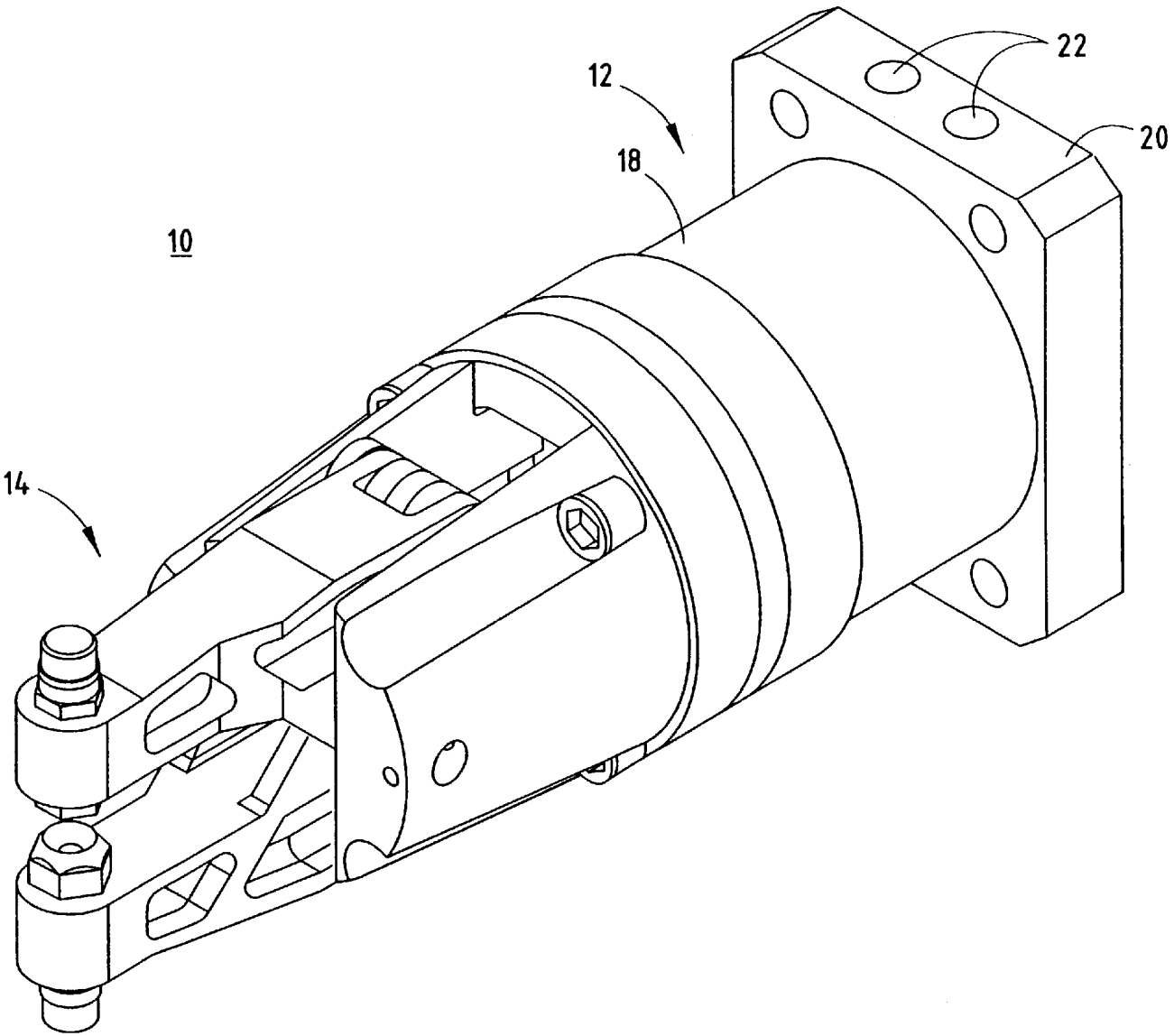
FIG. 1 is a perspective view of a workpiece holder useful with the present invention.
Figure 2:
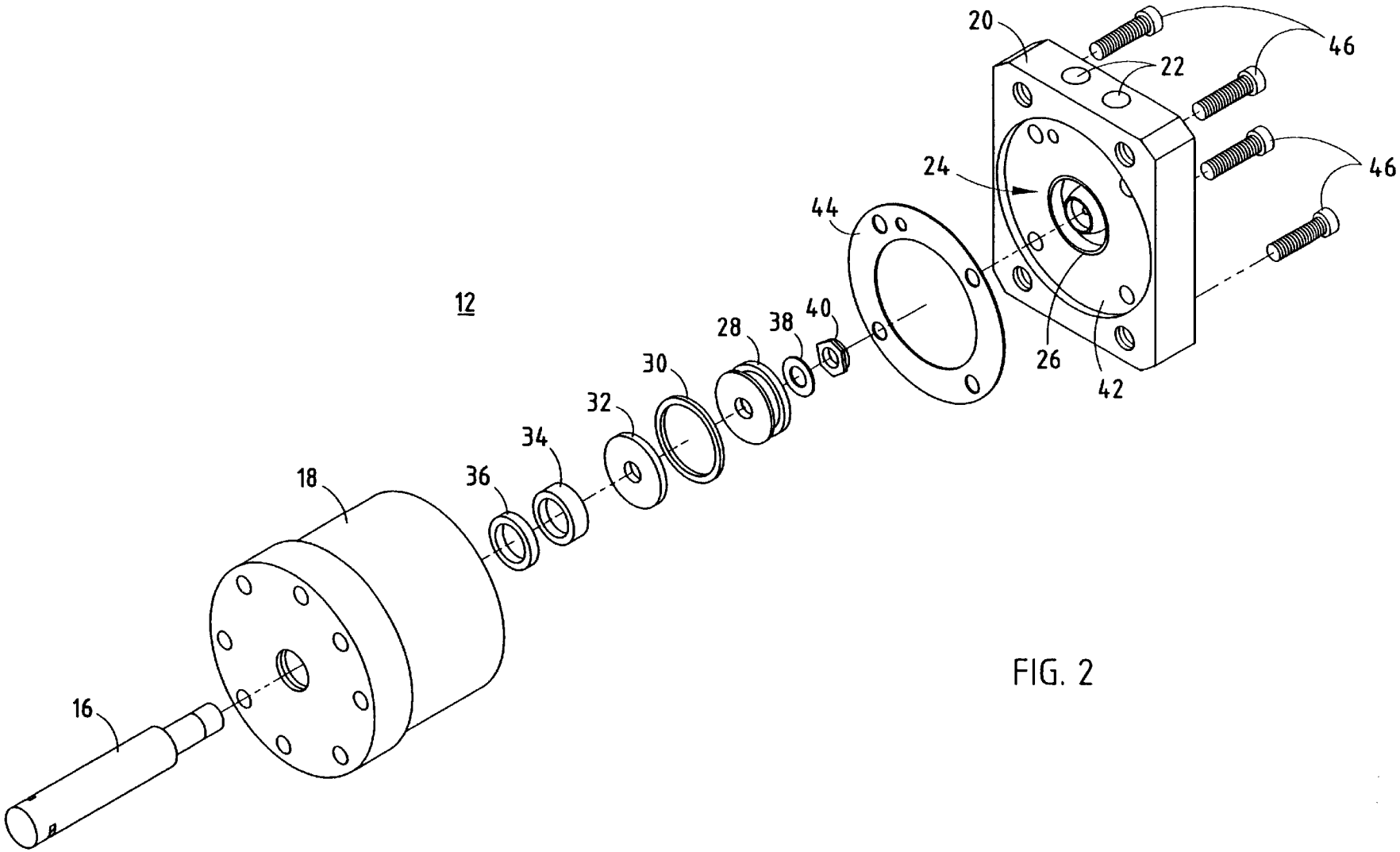
FIG. 2 is an exploded perspective view of a pneumatic cylinder incorporating a flow control device in accordance with the present invention.

Referring now specifically to the drawings and the illustrative embodiments depicted therein, a workpiece holder or gripper assembly 10 is connected to a fluid cylinder, such as pneumatic or air cylinder 12, which is operable to open and close a pair of gripping members 14 on the gripper assembly 10 via extension and retraction of a piston rod 16 of cylinder 12 (FIGS. 1 and 2). Pneumatic cylinder 12 includes a cylinder housing 18 and backing plate 20, which further includes one or more inlet or outlet ports 22 for providing fluid flow in either direction into or out from backing plate 20 to control the opening and closing of the gripper jaws via extension and retraction of piston rod 16 within cylinder 12. As shown in FIG. 2, backing plate 20 includes a flow control device or apparatus 24 which controls or restricts fluid flow between one or more ports 22 and the cylinder housing 18, as discussed in detail below. Flow control device 24 permits the fluid cylinder to operate in one direction, such as in extension of piston rod 16, at a full or generally non-restricted speed, while controlling or limiting the speed of the piston rod in the other direction, such as during retraction of the piston rod. Flow control device 24 further controls the retracting stoke of the cylinder by allowing a quick and initial movement of the piston rod and then a limited or decreased movement of the rod through the remainder of the retraction stroke, which controls the opening shock of the gripper assembly.

Flow control device 24 may be implemented at the backing plate 20 of any double action fluid cylinder, such as a pneumatic cylinder or hydraulic cylinder or the like, and may be implemented with a pneumatic cylinder connected to a workpiece holder or gripper assembly 10, as shown in FIG. 1. In the illustrated embodiments, flow control device 24 is adapted for use in a pneumatic cylinder 12. However, other fluid cylinder applications are clearly within the scope of the present invention. The gripper assembly 10 may be any known gripper or workpiece holder assembly or may be a gripper assembly of type disclosed in commonly assigned U.S. patent application Ser. No. 09/606,962, filed Jun. 29, 2000 by Keith S. Attee for ADJUSTABLE STROKE GRIPPER ASSEMBLY, now U.S. Pat. No. 6,361,095 (Atty. Docket No. CPI01 P-309), the disclosure of which is hereby incorporated herein by reference.

As shown in FIG. 2, pneumatic or air cylinder 12 includes a cylinder piston 28 which is movable along cylinder housing 18 in response to pressurized fluid or air at either side of piston 28. The air cylinder 12 further includes a seal 30 at cylinder piston 28 which seals piston 28 along the inner surface of cylinder 18 while allowing smooth movement of piston 28. A washer 32 is provided to receive an end of piston rod 16 therethrough and allow connection of the piston rod to a washer 38 and a nut 40 at an opposite side of piston 28, in order to retain piston rod 16 to piston 28, while allowing movement of piston rod 16 and substantially precluding air leakage from one side of piston 28 to the other. A bushing 34 and O-ring 36 are also provided to seal around the piston rod at the end of the cylinder. Cylinder housing 18 is further secured to backing plate 20 and within a large recessed region 42 via a gasket seal 44 and a plurality of fasteners or bolts 46. Flow control device 24 is preferably seated within a smaller, centrally positioned recess 26 of backing plate 20, such that flow control device 24 does not interfere with the other components of the air cylinder 12. The flow control device 24 of the present invention thus may be implemented in a conventional cylinder as an integral part of the backing plate, such that minimal modification of the cylinder is necessary.

Figure 4:
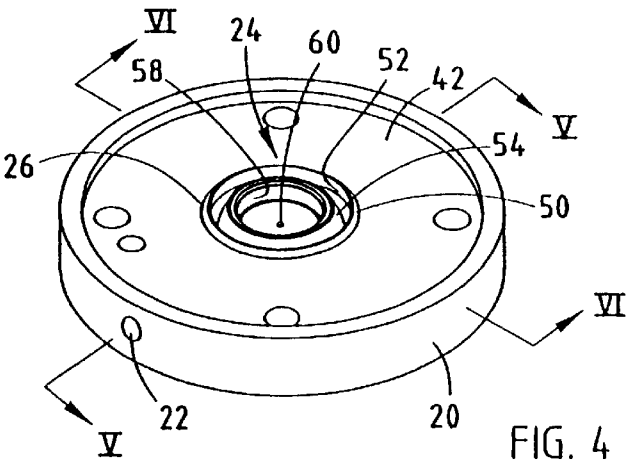
FIG. 4 is a perspective view similar to FIG. 3 with the flow control device assembled to the backing plate.
Figure 3:
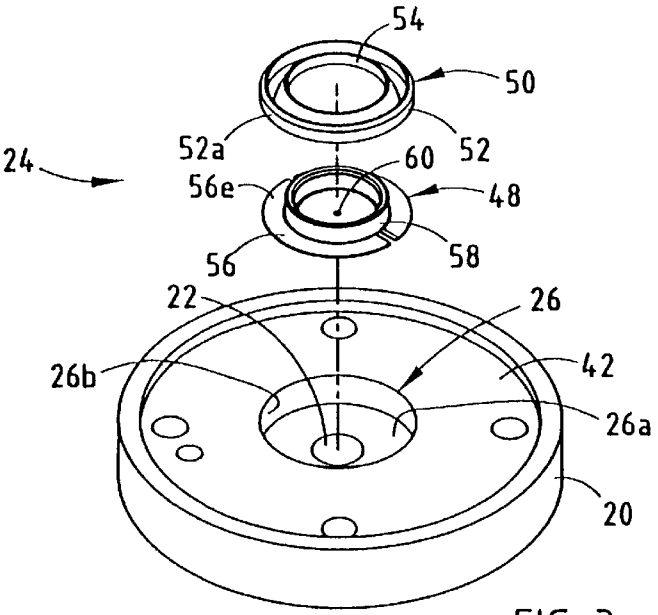
FIG. 3 is an exploded perspective view of the flow control device and a backing plate for use with a pneumatic cylinder similar to FIG. 2.
Figure 5:
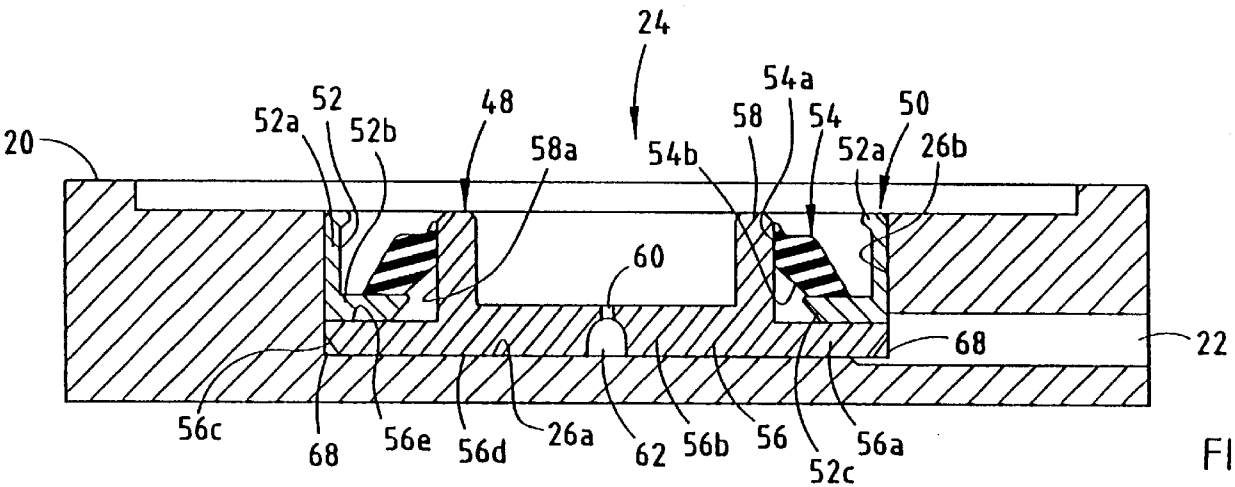
FIG. 5 is a sectional view of the backing plate and flow control device taken along the line V—V in FIG. 4.
Figure 6:
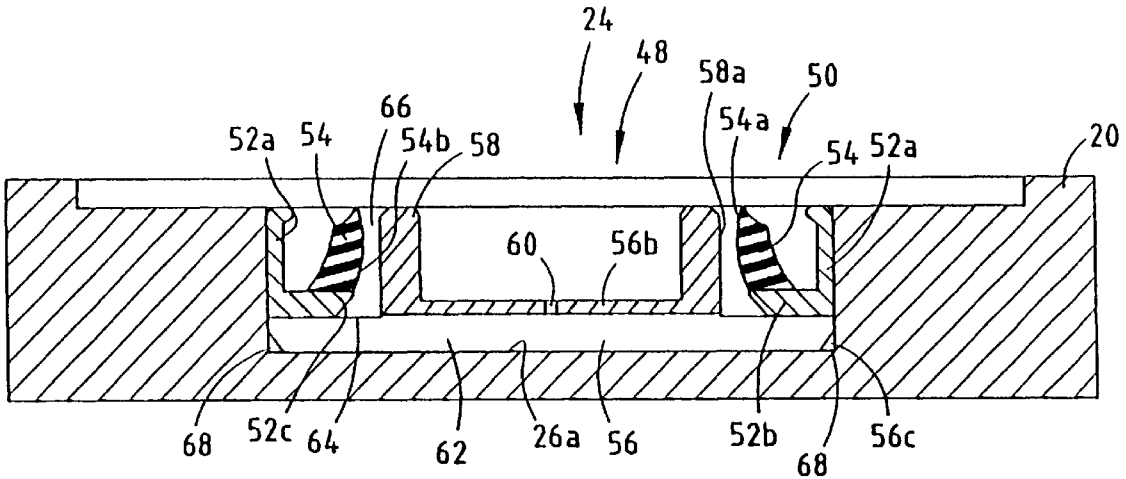
FIG. 6 is a sectional view taken along the line VI—VI in FIG. 4.

Backing plate 20 may be a generally rectangular backing plate as shown in FIGS. 1 and 2, or may be a round backing plate, as shown in FIGS. 3 and 4. Additionally, backing plate 20 may provide the inlet and/or outlet/exhaust ports 22 at a side of the backing plate (FIGS. 1 and 2) or may provide the ports through a central portion of the backing plate, as shown in FIG. 3, without affecting the scope of the present invention. As best shown in FIGS. 3, 5 and 6, backing plate 20 includes a generally cylindrical recessed portion 26, which includes an inner end wall portion 26*a* and a generally cylindrical side wall portion 26*b* extending outward from end wall portion 26*a* toward the cylinder side of backing plate 20. The air flow passageway or port 22 is connected to the end wall portion 26*a* of recess 26 either at a side region thereof (FIGS. 4 and 5) or at and through the end wall itself (FIG. 3), such that compressed or pressurized air may flow through backing plate 22 and flow control device 24, as discussed below.

Flow control device 24 includes a flow restricting member 48 and a sealing member 50. As seen in FIGS. 3–6, flow restricting member 48 is positioned at end wall 26*a* of recessed portion 26 of backing plate 20, while sealing member 50 is positioned around side wall portion 26*b* of recess portion 26 and is secured thereto in order to retain sealing portion 50 and flow restricting member 48 within the recessed portion 26 of backing plate 20. Sealing member 50 preferably includes a generally rigid body portion 52 and a flexible sealing portion 54. Body portion 52 is generally ring-shaped and includes a side wall portion 52*a* for engaging side wall portion 26*b* of recess 26 and a retaining portion 52*b* for retaining flow restricting member 48 at end wall portion 26*a* of recess 26, as best shown in FIGS. 5 and 6. Preferably, body portion 52 is made from aluminum or other generally rigid material and preferably is press-fit within recess 26 to provide a tight and sealed engagement between side wall portion 52*a* and side wall 26*b* of recess 26 and further to substantially retain flow restricting member 48 within the recess 26 when the flow control device 24 is installed at backing plate 20.

Sealing portion 54 is secured to body portion 52, such as at a radially inner end 52*c* of retaining portion 52*b* and extends radially inwardly therefrom for engagement with flow restricting member 48, as discussed in detail below. Sealing portion 54 is resilient and flexible, such that an engaging portion 54*a* may flex or otherwise move toward and away from flow restricting member 48 in response to air flow or pressure at either side of sealing member 54, as discussed in detail below.

Figure 9:
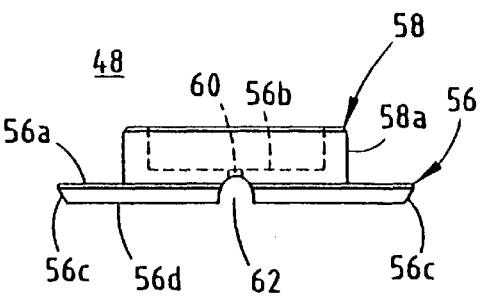
FIG. 9 is a side elevation of the flow restricting member of FIGS. 7 and 8.
Figure 8:
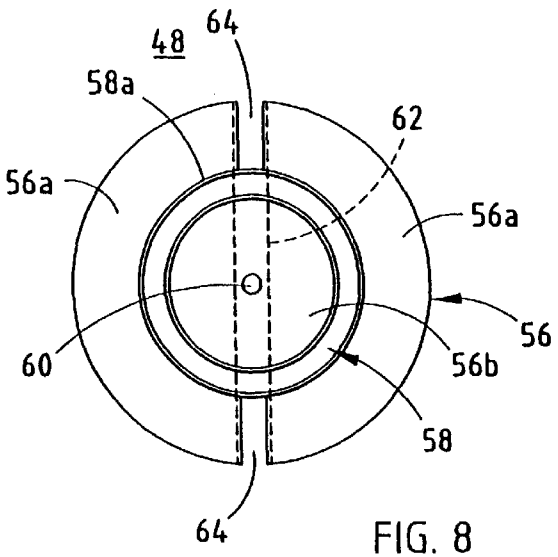
FIG. 8 is a top plan view of the flow restricting member of FIG. 7.
Figure 7:
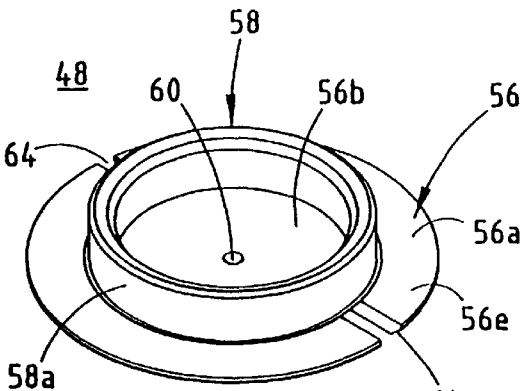
FIG. 7 is perspective view of a flow restricting member in accordance with the present invention.

Referring now to FIGS. 7–9, flow restricting member 48 includes a base portion 56 and a sealing portion 58. Sealing portion 58 is a generally cylindrical wall extending upward from base portion 56 and defines a generally smooth, continuous and uninterrupted sealing surface 58*a* about an outer surface thereof. Sealing surface 58 provides a smooth annular surface for engagement with sealing portion 54 of sealing member 50, as discussed below. Flow restricting member 48 further includes a first or central passageway 60, which is generally centrally positioned through base portion 56 and radially inward of sealing portion 58. Base portion 56 further includes a channel or groove 62 extending through base portion 56 and generally diametrically across a lower surface 56*d* of base portion 56. As can be seen from FIGS. 7–9, channel 62 provides a slotted opening 64 through an outer flange portion 56*a* of base portion 56 (FIGS. 7 and 8), while providing a passageway along the center portion 56*b* of base portion 56 and connecting to center orifice or passageway 60, as seen in FIG. 9. Channel 62 is generally normal to central orifice 60 and provides fluid communication between central orifice 60 and the outer perimeter of base portion 56. Preferably, as also seen in FIG. 9, flange portion 56*a* of base portion 56 includes a chamfered or tapered lower edge 56*c* about its perimeter, in order to facilitate air flow around base portion 56 to one or both ends of channel 62, as discussed below.

As best seen in FIGS. 5 and 6, flow restricting member or insert 48 is positioned within recess 26 of backing plate 20 such that a lower surface 56*d* of base portion 56 seats against or engages end wall portion 26*a* of recess 26. The size of base portion 56 may be selected to press fit within recess 26 or may be smaller than the diameter of recess 26, in order to allow some movement of flow restricting member within recess 26 of backing plate 20, without affecting the scope of the present invention. Sealing member 50 is positioned onto flow restricting member 48, such that sealing portion 58 of flow restricting member 48 extends through a generally circular opening defined by engaging portion 54*a* of sealing portion 54 of sealing member 50. Preferably, body portion 52 of sealing member 50 is selected such that side wall 52*a* of body portion 52 is press-fit within and against side wall portion 26*b* of recess 26, such that sealing member 50 is securely retained within recess 26 via the press-fit engagement. This provides a substantially tight sealing engagement between body portion 52 and side wall portion 26*b* of recess 26 and further functions to substantially retain flow restricting member 48 positioned against end wall 26*a* of recess 26 via engagement of retaining portion 52*b* of body portion 52 against an upper surface 56*e* of flange portion 56*a* of base portion 56. Accordingly, flow control device 24 is substantially fixed and sealed within recess 26 of backing plate 20, such that air flow between ports 22 and the air cylinder 12 is limited to flow through passageway 60 and between engaging portion 54*a* of seal portion 54 and sealing surface 58*a* of flow control insert or member 48, as discussed below.

During operation, flow control device 24 controls and restricts air flow to control operation of the workpiece holder. More particularly, with reference to FIGS. 5 and 6, when pressurized air is applied through port 22 in order extend piston rod 16 from cylinder 12, the air flows along channel 62 and through the first passageway or orifice 60. Additionally, air will flow along passageway or channel 62 and through openings or passageways 64 of flange portion 56*a* between radially inward end 52*c* of retaining portion 52*b* and sealing portion 58 of flow restricting member 48. As the pressurized air flows through openings 64 and onto an underside surface 54*b* of sealing portion 54, the pressure exerted by the air flow causes engaging portion 54*a* of sealing portion 54 to move or flex outwardly away from sealing surface 58*a* of flow restricting member 48 (FIG. 6), such that the air flows through passageway 64 and further through the generally ring-shaped opening or passageway 66 defined between sealing surface 58 and the sealing member 54. The opening 64 allows the air to travel to the backside of sealing portion 54. After a low amount of back pressure is achieved, the sealing portion 54 is pushed away from the cylindrical wall of the flow restricting member to allow relatively free or unrestricted flow through the flow control apparatus of present invention.

On the other hand, when the air flow is in the opposite direction, either via a pressurized air source at the other end of the air cylinder or via a vacuum applied at port 22, in order to retract the piston rod 16 into cylinder 12, the air flows through orifice 60 and along channel 62 and out through port 22. However, as the air flows along sealing surface 58*a*, engaging portion 54*a* of sealing portion 54 is pushed downward and inward to engage sealing surface 58*a* (FIG. 5), thereby substantially precluding air flow therebetween. Accordingly, air flow in the direction for retraction of the piston rod is substantially restricted or slowed via the flow control device of the present invention.

Additionally, the chamfered or tapered perimeter edge 56*c* of base portion 56 of flow restricting member 48 allows air to flow around the perimeter edge of base portion 56 between port 22 and one or both ends of the channel 62. With reference to FIGS. 5 and 6, in applications where the flow restricting member 48 may be tightly pressed against end wall 26*a* of recess 26, air will flow between port 22 and channel 62 via a passageway 68 defined between the tapered edge 56*c* and side wall 26*b* and end wall 26*a* of recess 26. The air thus flows circumferentially around the perimeter edge of base portion 56 in order to connect port or ports 22 to the channel 62 of flow restricting member 48.

Flow control device 24 thus restricts the speed of the piston in one direction, while allowing substantially unrestricted fluid flow and piston speed in the opposite direction. When compressed air is applied to retract the piston within the cylinder, the air pressure forces the sealing member into sealing engagement with the sealing surface of the flow restricting member and, thereafter, the air is exhausted only through center orifice 60 of the flow restricting member 48. As the compressed air is applied to retract the cylinder, the piston initially begins to move quickly. However, after the initial quick movement, pressure increases on the exhaust side of the piston, between the piston and the backing plate, because the flow control device 24 only permits air to exhaust through the smaller, centrally positioned orifice 60. Because the orifice 60 is much smaller than the diametric channel 62 and annular opening 66 between the sealing portion and sealing surface, the piston moves in a slower, controlled manner during retraction and avoids forcible contact between the piston and surrounding structure at full retraction.

Although shown and described as being generally cylindrical and positioned within a generally cylindrical recess, the insert or flow restricting member and sealing member of the present invention may be manufactured in different shapes and adapted to insert into existing packing plates of different shapes, without affecting the scope of the present invention.

Therefore, the present invention provides a flow restricting and controlling device which controls the fluid flow between a source, such as a compressed air source, and a fluid cylinder, such as a pneumatic cylinder. The flow control device is a single direction shock or speed control device and permits the fluid cylinder to travel in one direction, such as extension, at full or substantially unrestricted speed, yet limits the speed in the other direction, such as retraction. The speed of the retracting stroke is initially quick until the pressure builds up between the piston and the backing plate after the sealing portion is pressed back into sealing engagement with the sealing surface of the insert, because further flow in that direction is restricted to pass only through the central orifice of the insert or flow restricting member. The speed of the retracting stroke thus decreases through the remainder of the stroke, which is particularly useful to control the opening shock of the gripper assembly or workpiece holder.

The flow control device of the present invention is adapted to be integral with the backing plate of the fluid cylinder and is very compact is thus does not add to the length of known cylinder designs. Additionally, the device is highly durable and relatively inexpensive due to the minimal moving parts. There are no physical contact points with existing moving parts of the piston and cylinder assembly, such that the flow control device of the present invention may be applicable to existing fluid cylinders with minimal modification of the components of the fluid cylinder.

Changes and modifications in the specifically described embodiments can be carried out without departing from the principles of the invention, which is intended to be limited only by the scope of the appended claims, as interpreted according to the principles of patent law including the Doctrine of Equivalents.

The embodiments of the invention in which an exclusive property right or privilege is claimed are defined as follows:

1. A flow control apparatus for a fluid cylinder having a backing plate having a recess, the recess being defined by an inner surface and a side wall extending outwardly therefrom, the fluid cylinder being extendable and retractable in response to fluid flow through the backing plate;

a flow restricting member positionable substantially in the recess of the backing plate, said flow restricting member comprising a base portion and a generally continuous sealing surface, said base portion being positionable at the inner surface of the recess with said sealing surface extending within and along the side wall of the recess, said flow restricting member defining a first passageway through said base portion, wherein said first passageway of said flow restricting member comprises a generally centrally positioned orifice; and a sealing member positionable substantially around said sealing surface and in sealing engagement with the side wall of the recess, said sealing member being movable to engage and disengage said sealing surface, said sealing member being disengagable from said sealing surface to at least occasionally define a second passageway therebetween;

wherein said sealing member is movable to disengage said sealing surface in response to fluid flow in a first direction such that fluid flows through said second passageway and said first passageway in said first direction, said sealing member being movable to engage said sealing surface in response to fluid flow in a second direction to limit fluid flow through said second passageway in said second direction, such that fluid flows through said first passageway in said second direction.

2. The flow control apparatus of claim 1, wherein said sealing surface comprises a generally cylindrical surface positioned around said first passageway.

3. The flow control apparatus of claim 1, wherein said base portion of said flow restricting member is adapted to at least partially seat against the backing plate.

4. The flow control apparatus of claim 3, wherein said base portion defines a third passageway extending at least partially thereacross, said third passageway providing a passageway for fluid flow to said first and second passageways.

5. The flow control apparatus of claim 4, wherein said flow restricting member provides for fluid flow in said first direction from at least one port at the recess along said third passageway to said first and second passageways and for fluid flow in said second direction from said first passageway to at least one port at the recess.

6. A flow control apparatus for a fluid cylinder having a backing plate having a recess, the recess being defined by an inner surface and a side wall extending outwardly therefrom, the fluid cylinder being extendable and retractable in response to fluid flow through the backing plate;

a flow restricting member positionable substantially in the recess of the backing plate, said flow restricting member comprising a base portion and a generally continuous sealing surface, said base portion being positionable at the inner surface of the recess with said sealing surface extending within and along the side wall of the recess, said flow restricting member defining a first passageway through said base portion, said base portion of said flow restricting member being adapted to at least partially seat against the backing plate; and a sealing member positionable substantially around said sealing surface and in sealing engagement with the side wall of the recess, said sealing member being movable to engage and disengage said sealing surface, said sealing member being disengagable from said sealing surface to at least occasionally define a second passageway therebetween, said base portion defining a third passageway extending at least partially thereacross, said third passageway providing a passageway for fluid flow to said first and second passageways;

wherein said sealing member is movable to disengage said sealing surface in response to fluid flow in a first direction such that fluid flows through said second passageway and said first passageway in said first direction, said sealing member being movable to engage said sealing surface in response to fluid flow in a second direction to limit fluid flow through said second passageway in said second direction, such that fluid flows through said first passageway in said second direction, said flow restricting member providing for fluid flow in said first direction from at least one port at the recess along said third passageway to said first and second passageways and for fluid flow in said second direction from said first passageway to at least one port at the recess, wherein said base portion of said flow restricting member includes a chamfered perimeter edge to allow fluid flow around said base portion between at least one end of said third passageway and the at least one port.

7. A flow control apparatus for a fluid cylinder having a backing plate and being extendable and retractable in response to fluid flow through said backing plate, said flow control apparatus comprising:

a flow restricting member adapted for positioning at the backing plate, said flow restricting member having a first passageway and a generally continuous sealing surface, said first passageway of said flow restricting member comprising a generally centrally positioned orifice and said sealing surface comprising a generally cylindrical surface positioned around said first passageway, said flow restricting member including a base portion adapted to seat against the backing plate, said base portion defining a third passageway extending at least partially thereacross, said third passageway providing a passageway for fluid flow to said first and second passageways; and a flexible sealing member positioned around said sealing surface and adapted for sealing engagement with the backing plate, said sealing member being movable to engage and disengage said sealing surface, said sealing member being disengagable from said sealing surface to at least occasionally define a second passageway therebetween;

wherein said sealing member is movable to disengage said sealing surface in response to fluid flow in a first direction such that fluid flows through said second passageway in said first direction, said sealing member being movable to engage said sealing surface in response to fluid flow in a second direction to limit fluid flow through said second passageway in said second direction, said flow control apparatus restricting fluid flow in said second direction to control operation of the fluid cylinder, wherein said flow restricting member and said sealing member are positionable within a recess in the backing plate, the recess being defined by an inner surface and a side wall extending outwardly therefrom, said base portion and the recess being formed such that said base portion is positionable at the inner surface of the recess with said sealing surface extending within and along the side wall of the recess.

8. The flow control apparatus of claim 7, wherein said sealing member is adapted to be positioned within the recess and engage the side wall of the recess to secure said sealing member and said flow restricting member within the recess.

9. The flow control apparatus of claim 7, wherein said sealing member includes a generally rigid body portion adapted to engage the side wall of the recess and a flexible sealing portion extending from said body portion and being adaptable to engage said sealing surface of said flow restricting member in response to fluid flow in said second direction.

10. The flow control apparatus of claim 9, wherein said generally rigid body portion of said sealing member is engaged with said base portion of said flow restricting member.

11. The flow control apparatus of claim 9, wherein said generally rigid body portion of said sealing member is adaptable to be press fit within the recess of the backing plate.

12. The flow control apparatus of claim 7, wherein said flow restricting member provides for fluid flow in said first direction from at least one port at the inner surface of the recess along said third passageway to said first and second passageways and for fluid flow in said second direction from said first passageway to the at least one port.

13. The flow control apparatus of claim 12, wherein said base portion of said flow restricting member includes a chamfered perimeter edge to allow fluid flow around said base portion between at least one end of said third passageway and the at least one port.

14. The flow control apparatus of claim 7, wherein said first direction of fluid flow causes extension of a piston within the cylinder and said second direction of fluid flow causes retraction of the piston.

15. The flow control apparatus of claim 14, wherein the fluid cylinder is adapted for use with a workpiece holder.

16. The flow control apparatus of claim 7, wherein the fluid cylinder is adapted for use with a workpiece holder.

17. A fluid cylinder for extending and retracting a piston in response to fluid flow, the cylinder being adaptable for connection to a workpiece holder and comprising:

a cylinder housing for housing the piston, the piston being extendable and retractable along and within said housing in response to the fluid flow;

a backing plate at one end of said housing, said backing plate having at least one port for fluid flow therethrough and a recess having an inner wall portion interconnected with said at least one port and a side wall portion extending from said inner wall portion toward said cylinder housing; and a flow control apparatus positionable within said recess and comprising:

a flow restricting member positioned at said inner wall portion of said recess, said flow restricting member comprising a first passageway and a generally cylindrical sealing surface positioned around said first passageway, said flow restricting member including a base portion adapted to seat against said inner wall of said recess of said backing plate with said sealing surface extending within and along the wall of the recess; and a sealing member comprising a generally rigid body portion and a flexible sealing portion extending from said body portion, said generally rigid body portion being adapted to engage said side wall of said recess and said flexible sealing portion being positioned around said sealing surface of said flow restricting member for sealing engagement with said sealing surface, said flexible sealing portion being movable from said sealing surface to at least occasionally define a second passageway therebetween in response to fluid flow in a first direction, said base portion defining a third passageway extending at least partially thereacross, said third passageway providing a passageway for fluid flow to said first and second passageways;

wherein said flexible sealing portion is movable to disengage said sealing surface in response to fluid flow in said first direction such that fluid flows through said first and second passageways in said first direction, said flexible sealing portion being movable to engage said sealing surface in response to fluid flow in a second direction to limit fluid flow through said second passageway in said second direction, said flow control apparatus thereby restricting fluid flow in said second direction to control operation of said fluid cylinder, wherein said sealing member and said flow restricting member are secured within said recess via engagement of said body portion of said sealing member with said side wall of said recess.

18. The fluid cylinder of claim 17, wherein said piston is extendable in response to fluid flow in said first direction and retractable in response to fluid flow in said second direction.

19. A fluid cylinder for extending and retracting a piston in response to fluid flow, the cylinder being adaptable for connection to a workpiece holder and comprising:

a cylinder housing for housing the piston, the piston being extendable and retractable along and within said housing in response to the fluid flow;

a backing plate at one end of said housing, said backing plate having at least one port for fluid flow therethrough and a recess having an inner wall portion interconnected with said at least one port and a side wall portion extending from said inner wall portion toward said cylinder housing; and a flow control apparatus positionable within said recess and comprising:

a flow restricting member positioned at said inner wall portion of said recess, said flow restricting member comprising a first passageway and a generally cylindrical sealing surface positioned around said first passageway, said flow restricting member including a base portion adapted to seat against said inner wall of said recess of said backing plate with said sealing surface extending within and along the wall of the recess; and a sealing member comprising a generally rigid body portion and a flexible sealing portion extending from said body portion, said generally rigid body portion being adapted to engage said side wall of said recess and said flexible sealing portion being positioned around said sealing surface of said flow restricting member for sealing engagement with said sealing surface, said flexible sealing portion being movable from said sealing surface to at least occasionally define a second passageway therebetween in response to fluid flow in a first direction, said base portion defining a third passageway extending at least partially thereacross, said third passageway providing a passageway for fluid flow to said first and second passageways;

wherein said flexible sealing portion is movable to disengage said sealing surface in response to fluid flow in said first direction such that fluid flows through said first and second passageways in said first direction, said flexible sealing portion being movable to engage said sealing surface in response to fluid flow in a second direction to limit fluid flow through said second passageway in said second direction, said flow control apparatus thereby restricting fluid flow in said second direction to control operation of said fluid cylinder, wherein said generally rigid body portion of said sealing member is engaged with said base portion of said flow restricting member, said third passageway allowing fluid flow to said second passageway via at least one opening through said base portion between said sealing surface and said body portion.

20. The fluid cylinder of claim 19, wherein said flow restricting member provides for fluid flow in said first direction from said at least one port at said inner surface of said recess along said third passageway to said first and second passageways and for fluid flow in said second direction from said first passageway to said at least one port.

21. The fluid cylinder of claim 20, wherein said base portion of said flow restricting member includes a chamfered perimeter edge to allow fluid flow around said base portion between at least one end of said third passageway and said at least one port.

22. A fluid cylinder for extending and retracting a piston in response to fluid flow, the cylinder being adaptable for connection to a workpiece holder and comprising:

a cylinder housing for housing a piston, said piston being extendable along and within said housing in response to fluid flow in a first direction and being retractable along and within said housing in response to fluid flow in a second direction;

a backing plate at one end of said housing, said backing plate having at least one port for fluid flow therethrough and a recess having an inner wall portion interconnected with said at least one port and a side wall portion extending from said inner wall portion toward said cylinder housing; and a flow control apparatus positionable within said recess and comprising:

a flow restricting member positioned at said inner wall portion of said recess, said flow restricting member having a base portion, a first passageway and a sealing surface, said base portion defining a connecting passageway extending laterally thereacross and which is generally normal to said first passageway and in fluid communication with said first passageway; and a flexible sealing member having a body portion and a sealing portion, said body portion being engaged with said side wall of said recess and said sealing portion being positioned around said sealing surface of said flow restricting member for sealing engagement with said sealing surface, said sealing portion being movable from said sealing surface to at least occasionally define a second passageway therebetween in response to fluid flow in said first direction;

wherein said flow restricting member and said sealing member are cooperatively operable to allow fluid flow in said first direction from said at least one port through said connecting passageway and further through said first passageway and said second passageway, said flow restricting member and said sealing member being further cooperatively operable to allow fluid flow in a second direction through said first passageway and further through said connecting passageway to said at least one port, said sealing member being movable to engage said sealing surface in response to fluid flow in said second direction to limit fluid flow between said sealing member and said sealing surface in said second direction, said flow control apparatus thereby restricting fluid flow in said second direction to control operation of said fluid cylinder, wherein said body portion comprises a generally rigid body portion adapted to engage said side wall of said recess and said sealing portion comprises a flexible sealing portion extending from said body portion and being adaptable to engage said sealing surface of said flow restricting member in response to fluid flow in said second direction.

23. The fluid cylinder of claim 22, wherein said generally rigid body portion of said sealing member is engaged with said base portion of said flow restricting member, said connecting passageway providing fluid communication to said second passageway via at least one opening through said base portion between said sealing surface of said flow restricting member and said body portion of said sealing member.

24. The fluid cylinder of claim 23, wherein said flow restricting member provides for fluid communication in said first direction from said at least one port at said inner surface of said recess along said connecting passageway to said first and second passageways and for fluid communication in said second direction from said first passageway along said connecting passageway to said at least one port.

25. The fluid cylinder of claim 24, wherein said base portion of said flow restricting member includes a chamfered perimeter edge to allow fluid flow around said base portion between at least one end of said connecting passageway and said at least one port.

26. A flow control apparatus for a fluid cylinder having a backing plate having a recess, the recess being defined by an inner surface and a side wall extending outwardly therefrom, the fluid cylinder being extendable and retractable in response to fluid flow through the backing plate;

a flow restricting member positionable substantially in the recess of the backing plate, said flow restricting member comprising a base portion and a generally continuous sealing surface, said base portion being positionable at the inner surface of the recess with said sealing surface extending within and along the side wall of the recess, said flow restricting member defining a first passageway through said base portion; and a sealing member positionable substantially around said sealing surface and in sealing engagement with the side wall of the recess, said sealing member being movable to engage and disengage said sealing surface, said sealing member being disengagable from said sealing surface to at least occasionally define a second passageway therebetween;

wherein said sealing member is movable to disengage said sealing surface in response to fluid flow in a first direction such that fluid flows through said second passageway and said first passageway in said first direction, said sealing member being movable to engage said sealing surface in response to fluid flow in a second direction to limit fluid flow through said second passageway in said second direction, wherein said sealing member is adapted to engage the side wall of the recess to secure said sealing member and said flow restricting member within the recess.

27. The flow control apparatus of claim 26, wherein said sealing member comprises a generally rigid body portion adapted to engage the side wall of the recess and a flexible sealing portion extending from said body portion and being adaptable to engage said sealing surface of said flow restricting member in response to fluid flow in said second direction.

28. The flow control apparatus of claim 27, wherein said generally rigid body portion of said sealing member is engaged with said base portion of said flow restricting member.

* * * * *